US010500465B1

(12) United States Patent
Panaia

(10) Patent No.: US 10,500,465 B1
(45) Date of Patent: Dec. 10, 2019

(54) MULTI-FUNCTIONAL BASKETBALL CROSS-TRAINING DEVICE, SYSTEM, AND METHOD

(71) Applicant: Trevin J. Panaia, Horsham, PA (US)

(72) Inventor: Trevin J. Panaia, Horsham, PA (US)

( * ) Notice: Subject to any disclaimer, the term of this patent is extended or adjusted under 35 U.S.C. 154(b) by 0 days.

(21) Appl. No.: 15/877,211

(22) Filed: Jan. 22, 2018

Related U.S. Application Data

(60) Provisional application No. 62/554,940, filed on Sep. 6, 2017, provisional application No. 62/449,421, filed on Jan. 23, 2017.

(51) Int. Cl.
*A63B 69/00* (2006.01)

(52) U.S. Cl.
CPC ..... *A63B 69/0071* (2013.01)

(58) Field of Classification Search
CPC ..... A63B 69/0071
See application file for complete search history.

(56) References Cited

U.S. PATENT DOCUMENTS

| | | | | |
|---|---|---|---|---|
| 5,485,993 | A | 1/1996 | Lipsett | 273/1.5 A |
| 5,599,016 | A * | 2/1997 | Larkin | A63B 69/0071 473/448 |
| 5,800,291 | A | 9/1998 | Grover | 473/447 |
| 6,312,349 | B1 | 11/2001 | Roberts | 473/448 |
| 8,075,425 | B2 | 12/2011 | Conwright | 473/447 |
| 8,113,969 | B1 | 2/2012 | Martin | 473/447 |
| 8,647,220 | B2 | 2/2014 | Lloyd | 473/422 |
| 8,900,074 | B1 * | 12/2014 | Johnson | A63B 69/205 473/422 |
| 9,873,030 | B2 * | 1/2018 | Frostino | A63B 69/0071 |
| 2003/0211906 | A1 * | 11/2003 | Seltzer | A63B 69/0071 473/450 |
| 2007/0249434 | A1 | 10/2007 | Starr | 473/422 |
| 2009/0149281 | A1 * | 6/2009 | Johnson | A63B 69/34 473/447 |
| 2010/0160093 | A1 | 6/2010 | Macarthur | 473/447 |
| 2012/0208660 | A1 * | 8/2012 | Mayers | A63B 69/0071 473/447 |
| 2013/0059680 | A1 | 3/2013 | Lloyd | 473/422 |
| 2013/0143694 | A1 | 6/2013 | Conwright | 473/447 |

(Continued)

OTHER PUBLICATIONS

"Perfect Jump Shot Strap," product description, downloaded from http://www.hoopsking.com, Jan. 25, 2018 (3 pgs).

(Continued)

*Primary Examiner* — Jeffrey S Vanderveen
(74) *Attorney, Agent, or Firm* — Hayes Soloway P.C.

(57) ABSTRACT

A multi-functional basketball cross-training apparatus, system, and method are provided. The apparatus includes at least two substantially vertical members. At least two bases are connected to a lower portion of the at least two substantially vertical members, respectively. The two bases provide support for the at least two substantially vertical members on a ground surface. At least one cross bar is removably connectable between the at least two substantially vertical members. The cross bar is position-adjustable along a vertical height of each of the two substantially vertical members. An upper portion of each of the at least two substantially vertical members has a plurality of members having a humanoid configuration.

11 Claims, 15 Drawing Sheets

(56) References Cited

U.S. PATENT DOCUMENTS

| | | | | |
|---|---|---|---|---|
| 2014/0287853 | A1 | 9/2014 | Heiling et al. | 473/447 |
| 2015/0165294 | A1 | 6/2015 | Wackerly | A63B 69/0071 |

OTHER PUBLICATIONS

"Plyometric Training Equipment Dribble Stick Basketball Dribble Trainer Outdoor," product description, downloaded from https://www.ebay.com, Jan. 25, 2018 (4 pgs).
"Powerarch," product description, downloaded from https://shop.powrehandz.com, Jan. 25, 2018 (4 pgs).
"Powernet Portable Pop Up Defender," product description, downloaded from https://www.anthem-sports.com, Jan. 25, 2018 (1 pg).
"SKLZ D-MAN Basketball Hands-Up Training Mannequin," product description, downloaded from https://www.anthem-sports.com, Jan. 25, 2018 (1 pg).
"SKLZ D-MAN Pro Portable Adjustable Basketball Trainer" product description, downloaded from https://www.anthem-sports.com, Jan. 25, 2018 (1 pg).
"SKLZ Dribble Stick Basketball Training Aid," product description, downloaded from https//www.anthem-vorts.com, Jan. 25, 2018 (1 pg).
"Spalding Basketball Universal Shot Trainer," product description, downloaded from https://www.discksportinggoods.com, Jan. 25, 2018 (3 pgs).

* cited by examiner

MULTI-FUNCTIONAL BASKETBALL CROSS-TRAINING DEVICE, SYSTEM, AND METHOD

CROSS REFERENCE TO RELATED APPLICATIONS

This application claims priority from U.S. Provisional Application Ser. No. 62/449,421, filed Jan. 23, 2017 and U.S. Provisional Application Ser. No. 62/554,940, filed Sep. 6, 2017, the contents of which are incorporated herein by reference, in their entireties.

FIELD OF THE DISCLOSURE

The present disclosure is generally related to athletic training devices and more particularly is related to a multi-functional basketball cross-training device and related systems and methods.

BACKGROUND OF THE DISCLOSURE

Training devices are used in sports to help athletes learn and practice proper athletic techniques, including techniques for maintaining proper body positioning and techniques for controlling an object used in the sport, such as a racket or a ball. Learning the proper athletic techniques and being able to practice those techniques can help athletes succeed in the sport and prevent injuries to themselves. For sports involving adolescents, the availability of training equipment and devices is often significantly limited due to limited financial budgets. Thus, it is highly desirable to employ training devices which assist with skill development for athletes across a wide range of ages and with varying skill sets, such that a single training device can be used for both teaching young athletes basic skills and to help more experienced athletes hone their skills. While a plethora of athletic training devices are available, many are limited in their usefulness to certain athlete ages or skills, and most devices only allow an athlete to practice a single skill or technique on them. As a result, these types of athletic training devices often have limited utility and commonly fail at maintaining an adolescent athlete's interest for long term use.

Thus, a heretofore unaddressed need exists in the industry to address the aforementioned deficiencies and inadequacies.

SUMMARY OF THE DISCLOSURE

Embodiments of the present disclosure provide an apparatus, system and method for multi-functional basketball cross-training. Briefly described, in architecture, one embodiment of the apparatus, among others, can be implemented as follows. At least two substantially vertical members are provided. At least two bases are connected to a lower portion of the at least two substantially vertical members, respectively. The at least two bases provide support for the at least two substantially vertical members on a ground surface. At least one cross bar is removably connectable between the at least two substantially vertical members. The at least one cross bar is position-adjustable along a vertical height of each of the two substantially vertical members. An upper portion of each of the at least two substantially vertical members has a plurality of members having a humanoid configuration.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claim.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
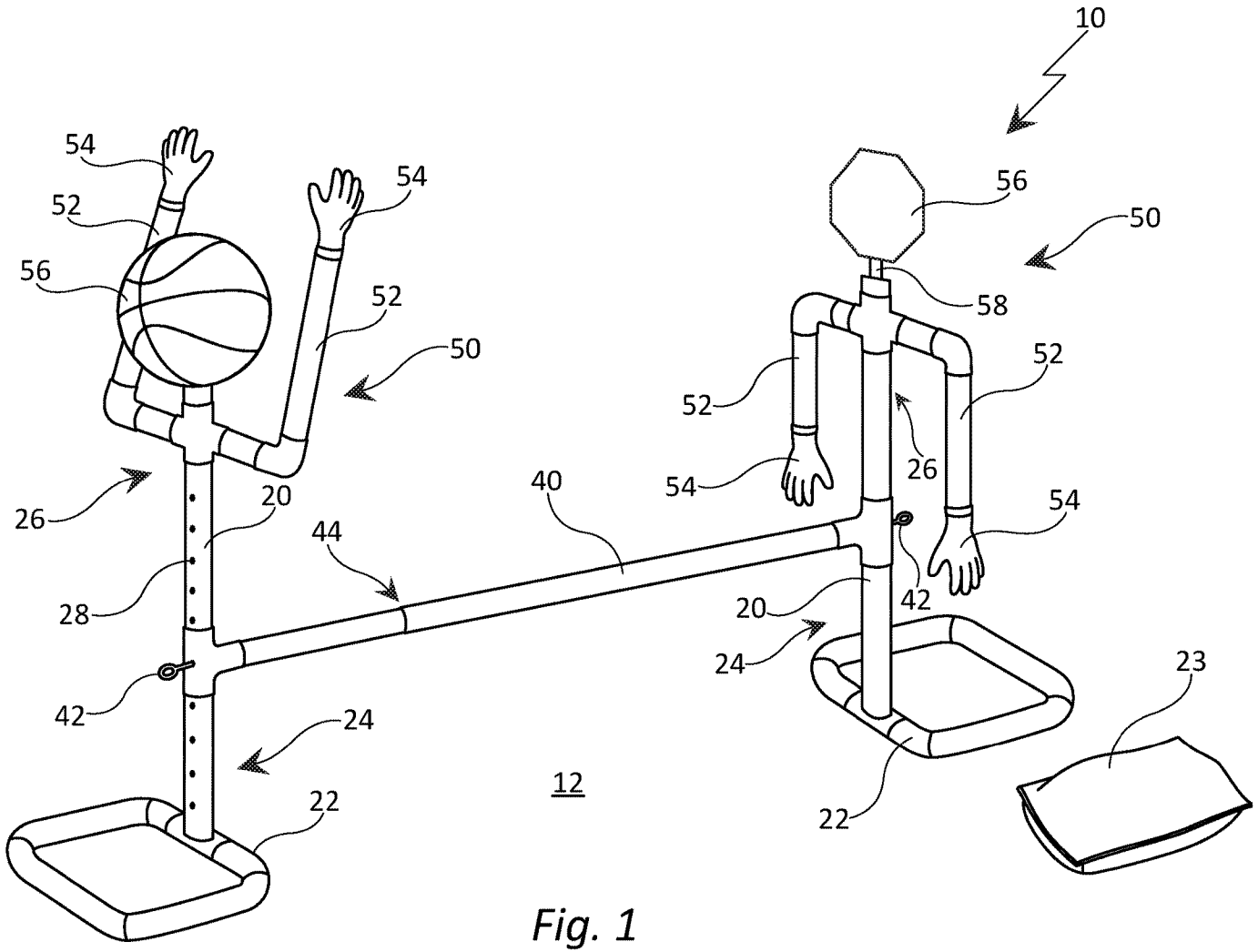
FIG. 1 is an elevated view illustration of a multi-functional basketball cross-training apparatus, in accordance with a first exemplary embodiment of the present disclosure.

FIG. 1 is an elevated view illustration of a multi-functional basketball cross-training apparatus 10, in accordance with a first exemplary embodiment of the present disclosure. The multi-functional basketball cross-training apparatus 10, which may be referred to simply as 'apparatus 10' may provide significant improvements in the industry of athletic training devices, especially for youth and adolescent basketball athletes. While the numerous benefits of the apparatus 10 are discussed throughout this disclosure, the apparatus 10 may provide specific benefits in helping basketball athletes of all ages practice the different skills required in basketball with a single, easy to use device.

In particular, the apparatus 10 is designed to help a player develop and sharpen the basic fundamental skills of basketball. It is essential, especially at a young age, to create proper form and good habits. The apparatus 10 may be used with practicing dribbling skills (all the different types of dribbles) at all different heights. The apparatus 10 also works with helping a player practice proper shooting form (proper leg and feet positions) to get the player used to shooting the basketball with the presence of a defender behind and in front of them. With the adjustable members of the apparatus 10, the cross bar 40 in particular, a player can practice his or her vertical jumping (by setting the bar higher) and agility work (by setting the bar lower). The player has the ability to work on passing skills with another player/person. The apparatus 10 also separates from one device into two different structures, i.e., into a screener and/or defender, which allows a player to practice on other aspects of the game. The apparatus 10 is an ideal tool for a coach to use to help develop a basketball player's skills using proper form and developing good habits. The apparatus 10 can be used outdoors in the driveway, basketball parks, as well as indoor courts.

As shown in FIG. 1, the apparatus 10 has at least two substantially vertical members 20. At least two bases 22 are connected to a lower portion 24 of the at least two substantially vertical members 20, respectively. The at least two bases 22 provide support for the at least two substantially vertical members 20 on a ground surface 12. At least one cross bar 40 is removably connectable between the at least two substantially vertical members 20. The at least one cross bar 40 is position-adjustable along a vertical height of each of the two substantially vertical members 20. An upper portion 26 of each of the at least two substantially vertical members 20 has plurality of members 50 having a humanoid configuration.

The apparatus 10 may be constructed from a plurality of structures, preferably light weight but durable, such as for example, PVC pipes, aluminum tubes, or other structures that maintain the desired structure of the apparatus 10. That structure generally includes having two or more vertical members 20 which are positioned in a substantially vertical position, e.g., with an elongated axis of the members positioned upright. The vertical members 20 may be supported on the ground surface 12 with a base 22, which may have varying designs. As shown in FIG. 1, the base 22 is formed to have a relatively large surface outline, as compared to a cross-section of the vertical member 20, such that the base 22 has sufficient contact with the ground surface 12 to enable the vertical member 20 to maintain an upright position. The base 22 may have an open interior portion, as shown in FIG. 1, or it may have other designs, such as a closed interior, a solid base, a base with legs or feet for contacting the ground, or other designs. The base 22 may optionally be used with a weight, such as a sandbag 23, which can be placed on the base 22 as needed. It is noted that the base 22 may also include an internal weight, such as water or sand positioned internal of the framework of the base 22. The vertical members 20, bases 22, cross bar 40, and other elements may be joined by pipe and tube structures commonly used with such materials, for instance, elbow and tee sockets.

The vertical members 20 are positioned to rise a substantial distance above the ground surface 12, such as, in one example, approximately 43 inches. One or more extenders can be added to the vertical member 20 to increase the height of the apparatus 10, in some cases, allowing the apparatus 10 to mimic the height of a six foot, five inch tall person. The cross bar 40 may be movably attached along a midsection of the vertical members 20, such that the height of the cross bar 40 relative to the ground surface 12 can be adjustable. The adjustability of the cross bar 40 may be manually selected by the user, and may be controlled using a variety of different structures or designs. For example, as shown in FIG. 1, adjustment of the cross bar 40 may be controlled using a pin 42 which is insertable into one of a plurality of holes 28 within the vertical member 20. To adjust the height of the cross bar 40, the user may remove the pin 42, slide the cross bar 40 up or down on the vertical member 20, and then reinsert the pin 42 in the desired hole 28. In addition to the height of the cross bar 40 being adjustable, the length of the cross bar 40, as measured between the vertical members 20, may also be adjustable. This adjustability may be provided using different designs, such as by adding an extension bar to the cross bar 40, with a telescoping design with one side of the cross bar 40 insertable and removable from within the other side of the cross bar 40. In most situations, extending the length of the cross bar 40 will result in a joint 44 within a middle section of the cross bar 40. This combined adjustability allows the cross bar 40 to have varying lengths and varying heights, as will be discussed in further detail relative to other figures.

Along the upper portion 26 of each of the vertical members 20, a humanoid configuration of members 50 is provided. This humanoid configuration is intended to provide the user of the apparatus 10 with a representation of an opposing basketball player, the presence of which in the apparatus 10 can help build confidence in young player by permitting them to practice basketball skills seemingly in the presence of other players. While the exact shape and structure of the humanoid configuration may vary, the members 50 from which it is constructed may include at least two arm members 52 having hand members 54. The arm members 52 may be rotatable about a horizontal axis to allow the hand members 54 to be positioned between a raised position, as shown in the left side of FIG. 1, and a lower positioned, as shown in the right side of FIG. 1. The arm members 52 may be attached via horizontal shoulder members connected to the vertically members 20 along the upper portion 26. The arm members 52 and hand members 54 may be formed from various materials, including the same as the other members of the apparatus 10. In one example, the hand members 54 may be formed from cloth gloves, whereas in another example, the hand members 54 may be formed from rigid members or semi-rigid members, such as those manufactured from foam or rubber.

The members 50 forming the humanoid configuration may also include a head member 56, which may include stationary and affixed head members 56 or head members 56 which are balanced on the top end of the vertical member 20. For example, on the left side of FIG. 1, the head member 56 is formed from a basketball which is balanced on the top of the vertical member 20. This balancing of the head member 56 may provide important benefits in using the apparatus 10, in that, if the user of the apparatus 10 contacts the apparatus 10 to a significant degree, the basketball balanced as the head member 56 on the vertical member 20 will fall. This feature may provide the user with a clear indication that the apparatus 10 was contacted. In contrast, on the right side of FIG. 1, the head member 56 is a plate which is affixed to the top of the vertical member 20 with a neck 58, which may not be dislodged and fall when the apparatus 10 is contacted by the user. Other types of head members 56 may also be used, all of which as considered within the scope of the present disclosure.

As discussed relative to FIGS. 8A-9C, the apparatus 10 may be capable of separating into two or more different pieces, namely, into a defender and/or screener design. To achieve this separation, the cross bar 40 may be removed from the vertical members 20 such that each vertical member 20 can be positioned independent of the other. Then, the positioning of the arm members 52 can be adjusted between defending positions (left side of FIG. 1) and screening positions (right side of FIG. 1).

While many benefits of the apparatus 10 may be apparent, it is noted that the apparatus 10 may provide many benefits with practicing dribbling for youth athletes. The apparatus doesn't just work on one type of dribble; it works on all different types and variation of dribbling. With the height being able to adjust up and down, it can adapt to a player's height and size. Also, with a defender in front and behind, it simulates a presence of being surrounded and the player has to operate in a tighter space which provides more realistic game like situation. The apparatus 10 is also useful when practicing shooting over a defender. Also, having the cross bar 40 connecting the defenders, the player is able to practice proper form while straddling the bar. When the apparatus is used in a defender/screener position, it can be moved around the basketball court to simulate different situations, and in passing configurations, it can help players improve their passing accuracy. Additionally, the ability to conduct games involving basketball skills using two or more players with the apparatus 10 allows players to sharpen their skills while having fun.

Figure 2:
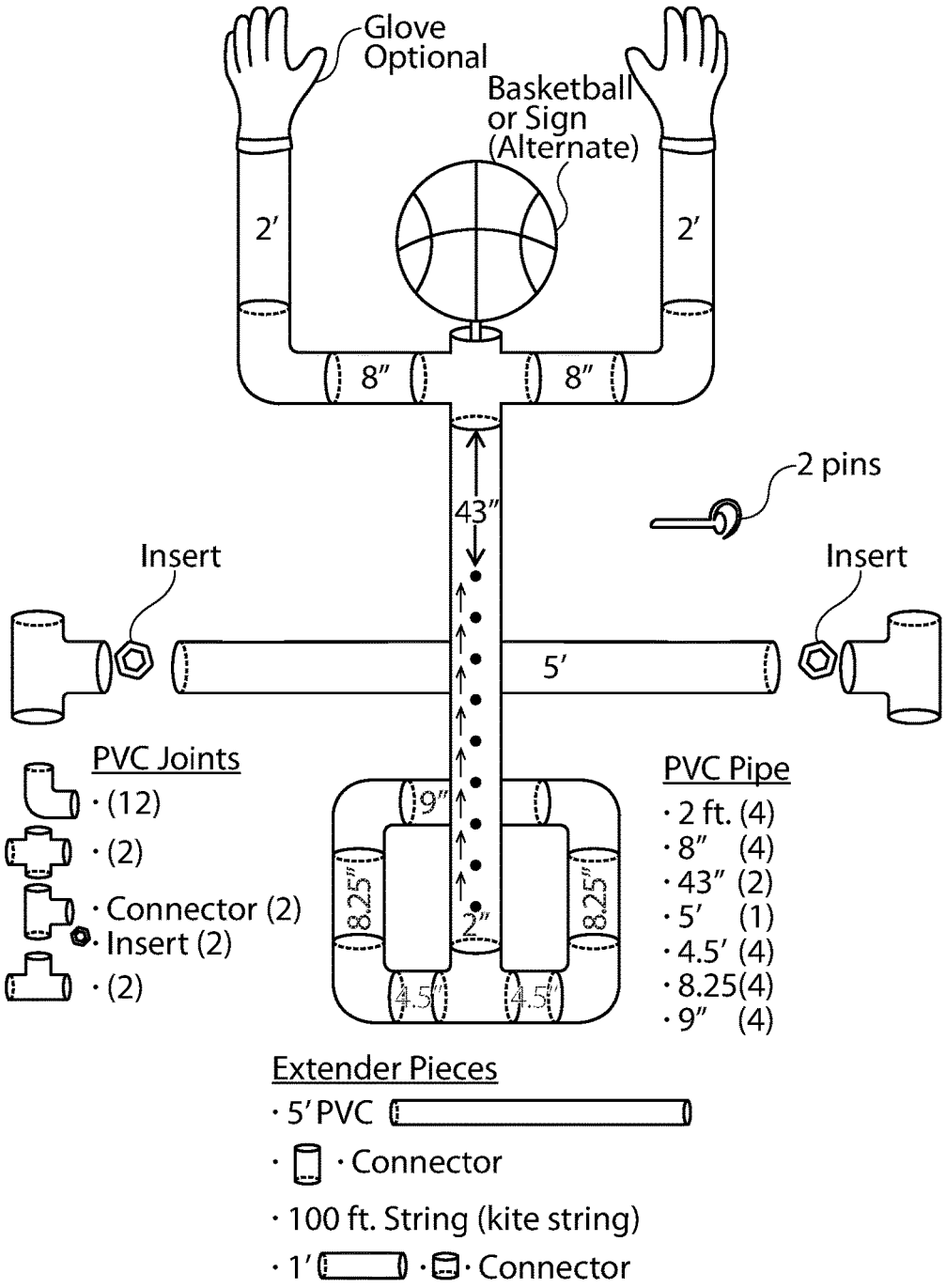
FIG. 2 is a schematic illustration of the parts used in the multi-functional basketball cross-training apparatus, in accordance with the first exemplary embodiment of the present disclosure.

FIG. 2 is a schematic illustration of the parts used in the multi-functional basketball cross-training apparatus 10, in accordance with the first exemplary embodiment of the present disclosure. Specifically, FIG. 2 provides a schematic view of the parts used for forming the apparatus 10, in one example. FIG. 2 also provides an example of the sizes of individual members and components of the apparatus in one example. Of course, additional parts or fewer parts may be employed, and any of the sizes of the parts may be adjusted, as will be determined based on the specific design of the apparatus 10.

Figure 3B:
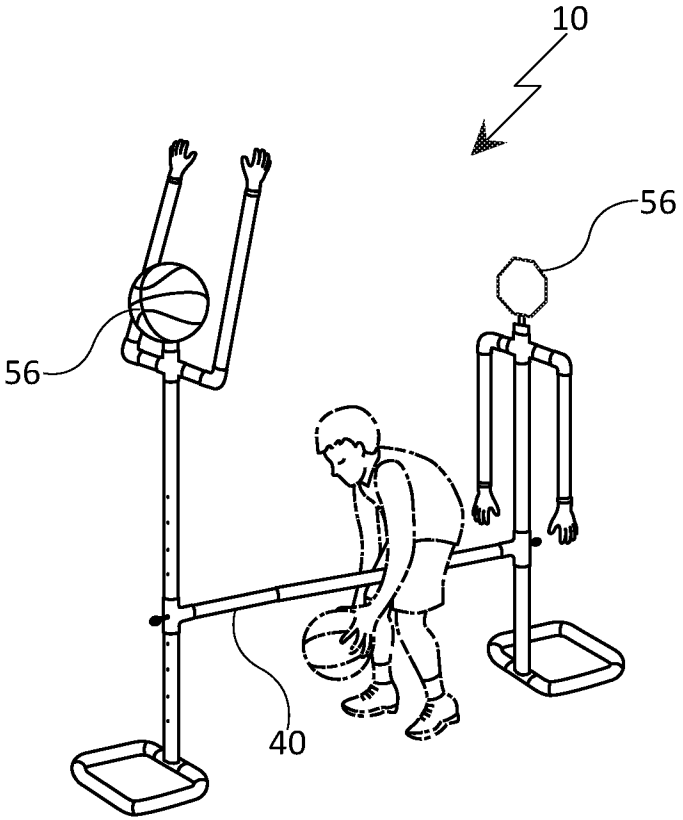
FIGS. 3A-3B are images of the multi-functional basketball cross-training apparatus in use with a basketball athlete in a dribbling position, in accordance with the first exemplary embodiment of the present disclosure.
Figure 3A:
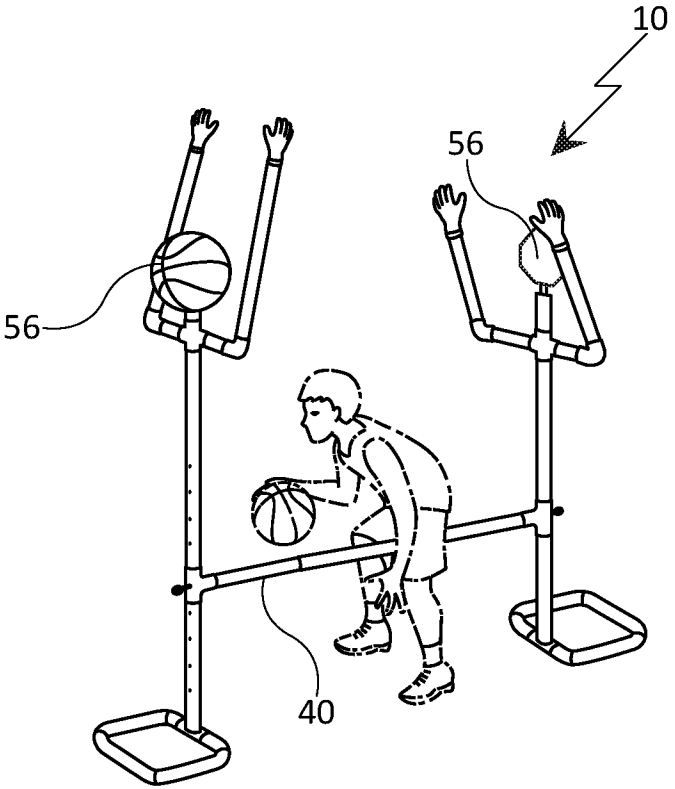

The functionality and use of the apparatus 10 is described relative to FIGS. 3A-10B. FIGS. 3A-3B are images of the multi-functional basketball cross-training apparatus 10 in use with a basketball athlete in a dribbling position, in accordance with the first exemplary embodiment of the present disclosure. Players of all ages, especially younger players, have a tendency to dribble the ball too high. With an adjustable cross bar 40 to stand over, it forces the player to keep the ball lower for the following dribbles: inside out dribble, crossover, through the legs, behind the back, spider dribble, FIG. 8 dribble, and a combination of all the dribbles. Also by straddling the cross bar 40, it puts the athletes' bodies in appropriate form by dropping their backsides to the cross bar 40. By using the adjustable cross bar 40, the athletes can keep an eye on the height of their dribble. The bar 40 can be lowered for a more challenging dribble which works on fingertip control. All of this is done while strengthening the player's legs. With the humanoid configuration in front and behind the athlete, it gives the athlete the feeling of being surrounded by defenders, which allows them to become more comfortable dribbling in tight spaces and feeling the presence of a defender. As shown in FIGS. 3A-3B, a basketball is used as the head member 56 for one of the humanoid configurations as part of a dribbling game. The object of the game is to perform a routine of all the different dribbling drills without hitting the cross bar 40 and knocking the basketball off of the defender. This is a great way to create self-discipline/goal setting, e.g., to see how far an athlete can get through the drills before knocking the head off. Through experimentation, the game has been found to be addicting to adolescent athletes, causing them to play it over and over again, which leads to more time put in to one of the most important aspects of basketball which is dribbling. This game has been found to be very beneficial to learn the proper form and accuracy of dribbling.

Figure 4:
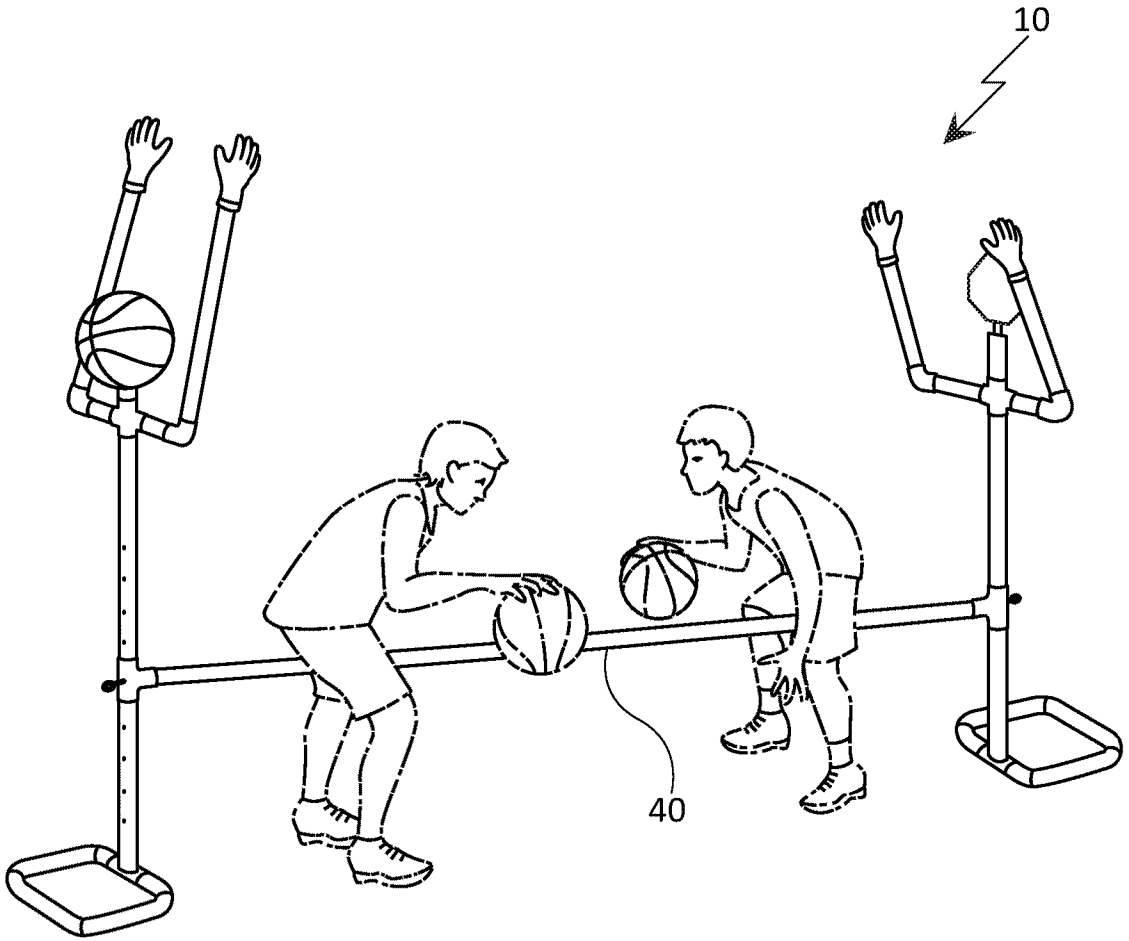
FIG. 4 is an image of the multi-functional basketball cross-training apparatus in use with two basketball athletes in a dribbling position, in accordance with the first exemplary embodiment of the present disclosure.

FIG. 4 is an image of the multi-functional basketball cross-training apparatus 10 in use with two basketball athletes in a dribbling position, in accordance with the first exemplary embodiment of the present disclosure. As shown, the cross bar 40 is in the extended configuration. This configuration of the apparatus 10 is also great for coaches to use for breakout stations during practices or basketball camps, and may be particularly useful with two or more athletes simultaneously. The advantage of having a partner on the drills is (1) they are facing each other which gives the sense of being guarded; (2) the speed and accuracy of the dribbles from each other creates competition; and (3) they have a greater chance of keeping their heads. The aforementioned Dribbling game can still be played with two players. They would go through the normal dribbling drills together. The first one to knock the basketball off the defender loses, or the first one to complete the dribbling routine first wins. It is also noted that the extended configuration of the apparatus 10 can be used with a single athlete to provide more space to work, such that the player can walk the line (move up the bar) which works on footwork as well as ball handling. It is further noted that additional extension members can be used with the cross bar 40 to provide a design which can allow four or more athletes to use the apparatus 10 at once. In this design, the cross bar 40 and extensions may form a crossed shape (+) such that there are four legs of the cross bar 40 to utilize. This is discussed in greater detail in FIGS. 12A-12B, below.

Figure 5C:
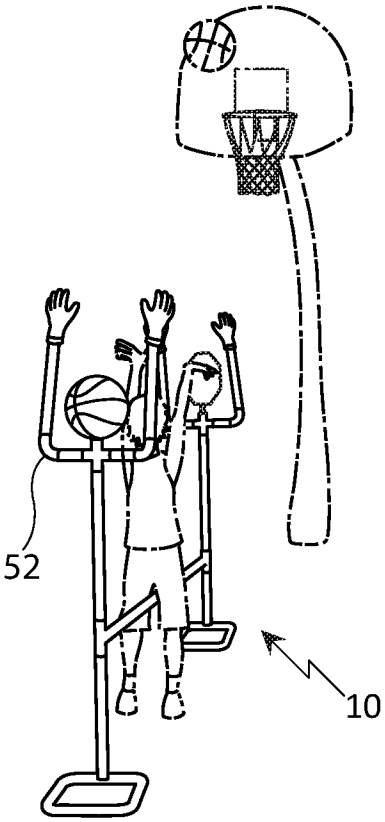
FIGS. 5A-5C are images of the multi-functional basketball cross-training apparatus in use with a basketball athlete in a shooting position, in accordance with the first exemplary embodiment of the present disclosure.
Figure 5B:
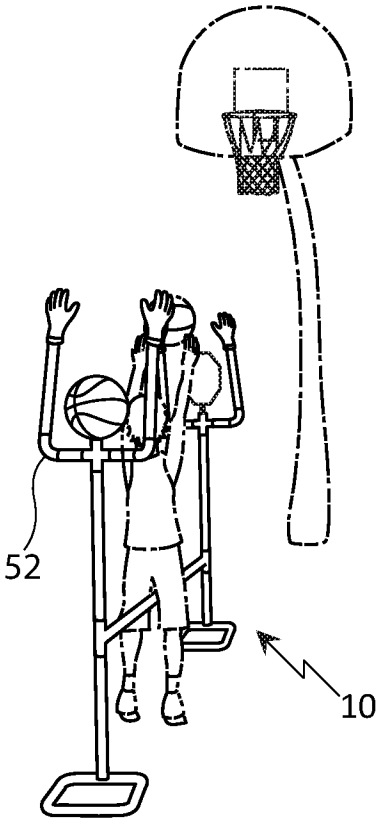
Figure 5A:
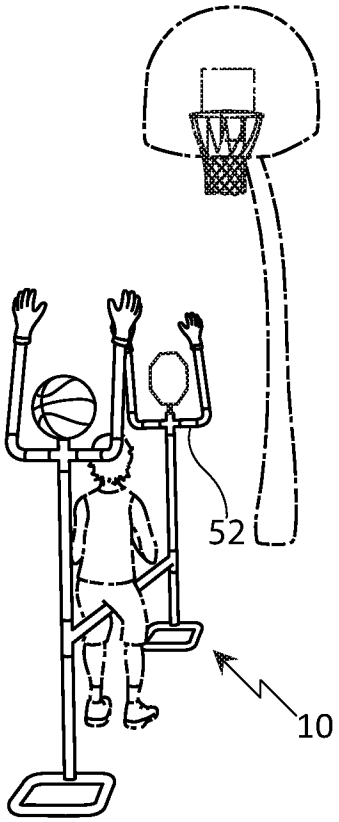

FIGS. 5A-5C are images of the multi-functional basketball cross-training apparatus 10 in use with a basketball athlete in a shooting position, in accordance with the first exemplary embodiment of the present disclosure. One unique feature of the apparatus 10 is it actually teaches a basketball athlete proper form. As shown in FIGS. 5A-5C, the athlete is working on his form shooting. There are a lot of components to a jump shot, but two highlighted issues that coaches struggle with when it comes to teaching young players how to shoot is getting proper spacing on their stance and getting them to drop their backside down to the proper height which creates power for their release. By having the player straddle the bar, it creates the proper spacing for their base. If they spread their legs too far, the bar will hit them when they bend down, if they are too close, they will not get low enough to touch the bar. The bar is adjustable based on the player's height, so it can be adjusted to the correct setting. When a player is practicing form shooting without the apparatus 10, they stand in front of the basket unguarded and without distraction. Using the apparatus 10 still allows them to work on their form without being blocked, and gets them used to having a physical presence in front of them while they are shooting, thereby mimicking actual play with a defending player. The arms 52 of the apparatus 10 are adjustable to create more of a presence of a hand in the athlete's face. Proper form is extremely important in basketball because shooting is using muscle memory. You want to create the same exact shot over and over. The apparatus 10 allows the player to create that muscle memory using proper form. Of particular note, typically when an athlete is between 4th and 5th grade, they are no longer allowed to jump over the foul line while shooting free throws. In one use of the apparatus 10, it can be put at the foul line in a sideways position with cross bar positioned in front of the player's legs, which can help the player not jump over the foul line.

Figure 6C:
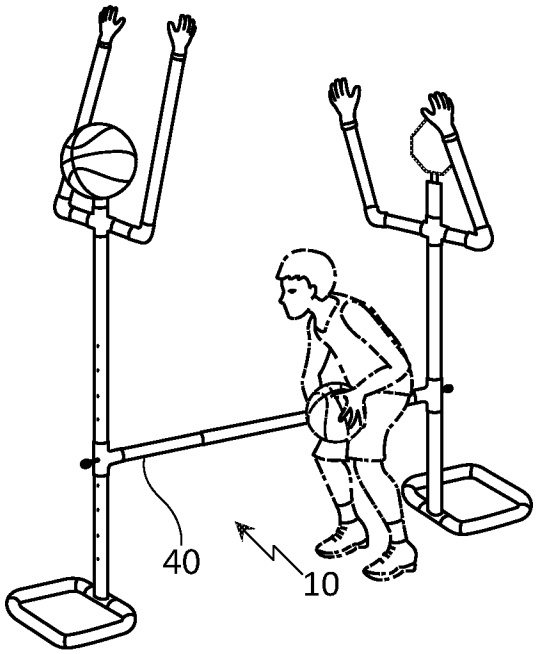
FIGS. 6A-6C are images of the multi-functional basketball cross-training apparatus in use with a basketball athlete in a raised jumping position, in accordance with the first exemplary embodiment of the present disclosure.
Figure 6B:
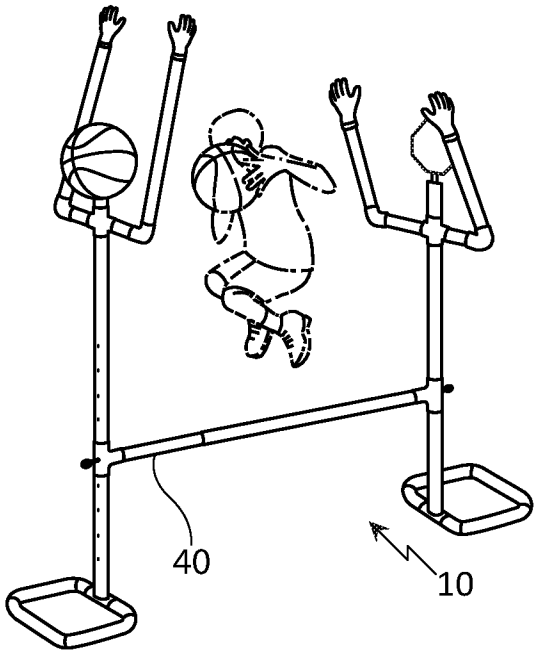
Figure 6A:
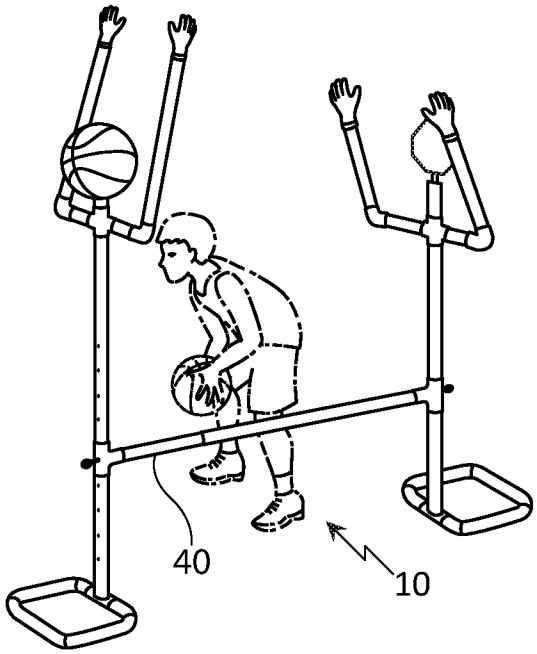

FIGS. 6A-6C are images of the multi-functional basketball cross-training apparatus 10 in use with a basketball athlete in a raised jumping position, in accordance with the first exemplary embodiment of the present disclosure. Another key area young players need to focus on is jumping. Younger players tend to have difficulty with creating space and really accelerating off the ground. With the apparatus 10, the cross bar 40 can be set to a challenging height and work on the player's vertical jump. Vertical jump is important for rebounding as well helping create space on offense to make getting a shot off easier. A regular basketball can be used or a weighted ball to make the drill more challenging. The side to side jumping also simulates more realistic movement in basketball since the player isn't always going to jump straight up for a shot or rebound.

Figure 7C:
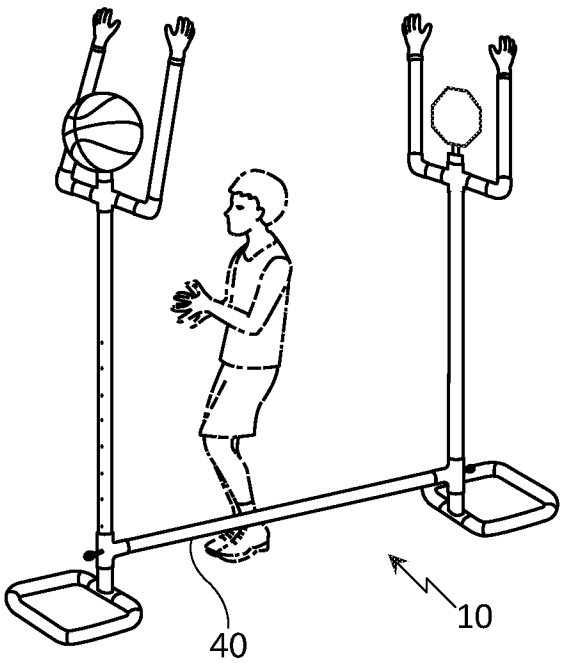
FIGS. 7A-7C are images of the multi-functional basketball cross-training apparatus in use with a basketball athlete in a lower jumping position, in accordance with the first exemplary embodiment of the present disclosure.
Figure 7B:
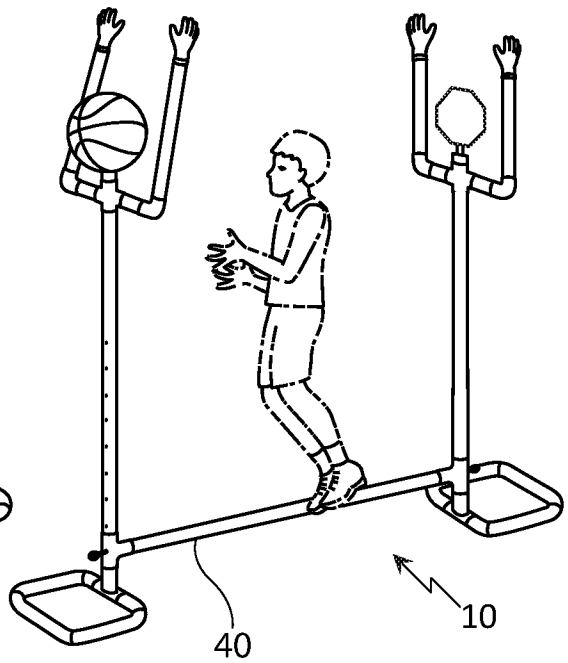
Figure 7A:
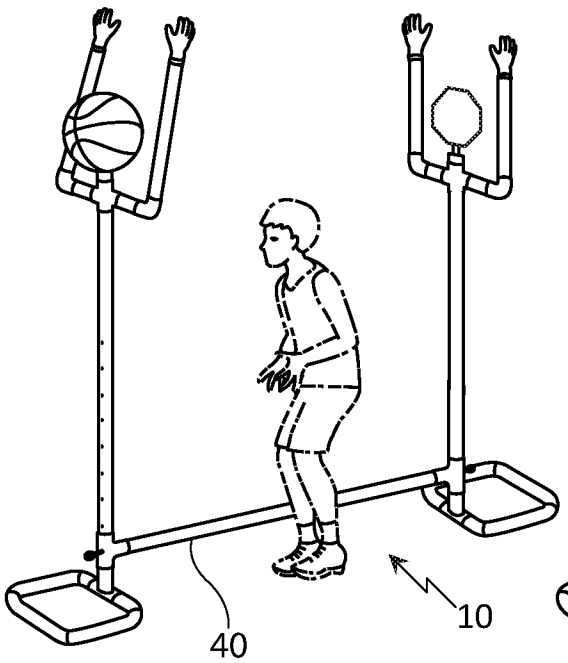

FIGS. 7A-7C are images of the multi-functional basketball cross-training apparatus 10 in use with a basketball athlete in a lower jumping position, in accordance with the first exemplary embodiment of the present disclosure. By dropping the cross bar 40 to lowest point, as shown in FIGS. 7A-7C, the athlete can practice advanced line jumps. Since the cross bar 40 is slightly raised off the ground, it forces the player to get over the cross bar 40 to complete one full jump. In contrast, when a player is using merely a line painted on the ground, they can easy hit the line without consequence, which creates bad habits and form. To really excel in basketball, speed and agility is key and the apparatus 10 helps accomplish that all on one device.

Figure 8A:
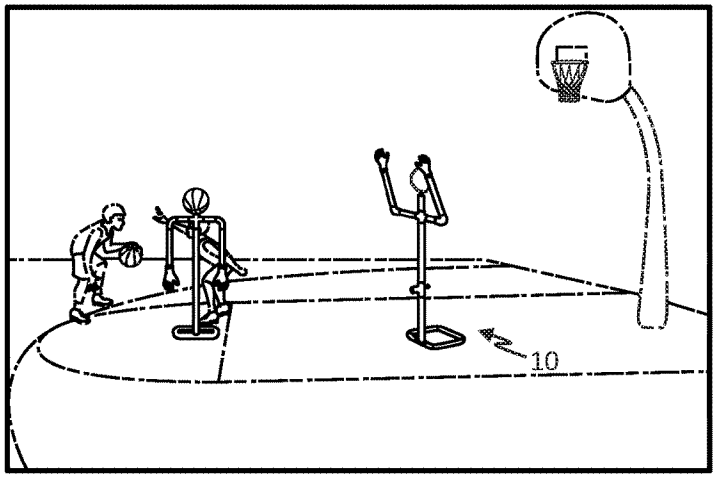
FIGS. 8A-8C and FIGS. 9A-9C are images of the multi-functional basketball cross-training apparatus in use with a basketball athlete in a screening and defending position, in accordance with the first exemplary embodiment of the present disclosure.
Figure 8B:
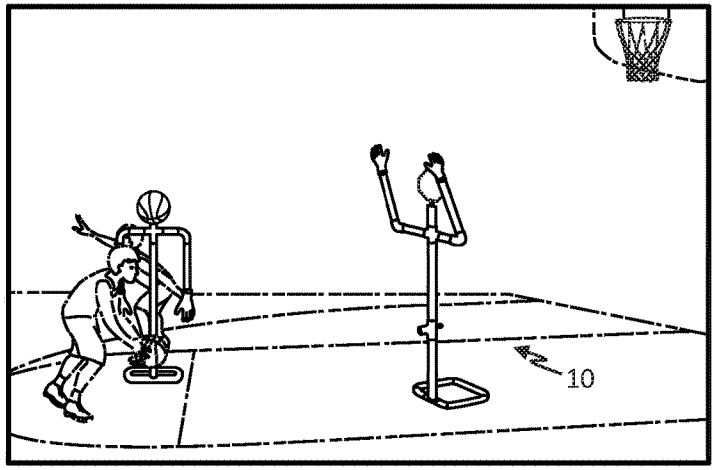
Figure 8C:
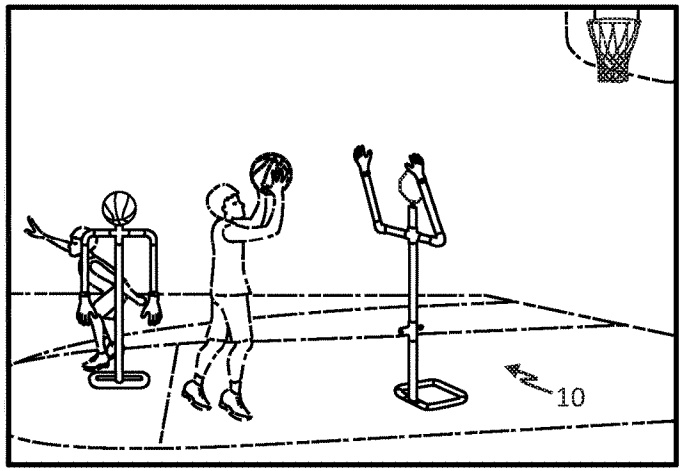
Figure 9C:
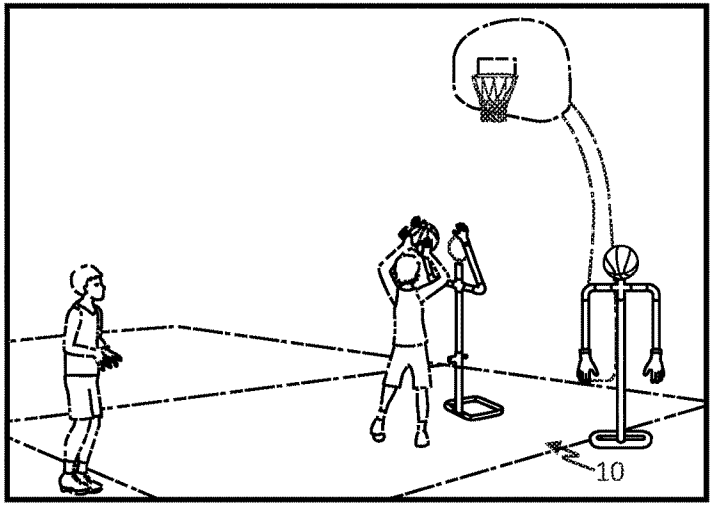
Figure 9A:
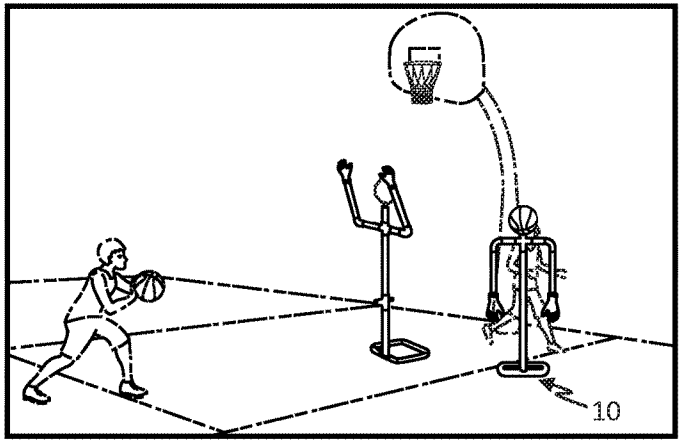
Figure 9B:
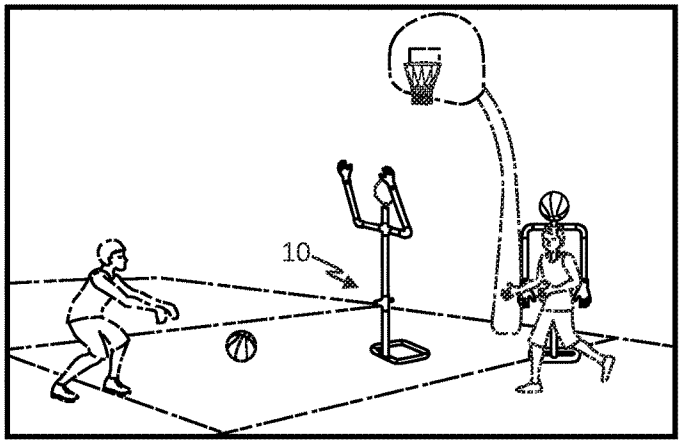

FIGS. 8A-8C and FIGS. 9A-9C are images of the multi-functional basketball cross-training apparatus 10 in use with a basketball athlete in a screening and defending position, in accordance with the first exemplary embodiment of the present disclosure. As shown in the figures, the apparatus 10 may be capable of breaking down or separating into either a screener or defender, or both. The player or coach can choose to have two screeners, two defenders, or one of each. Screening and defending drills can be done alone or with another player. In FIG. 8A, the player is dribbling his man off of the screener and then has to shoot over the defender, as shown in FIGS. 8B-8C. These figures show the effect of using the screener on the other player. While a real player (defender) is shown in FIGS. 8A-8C to show how the player would use the screener, it is also possible for a player to merely pretend they are being guarded and accomplish the same thing. This drill can be done at a local basketball court, or in a driveway with a basketball hoop. Parents of athletes that like to work out with their children will really appreciate the benefits of having an extra screener or defender. Players who work out on their own benefit from having something they can use to simulate additional players on the court. The screener/defender can be placed anywhere on a basketball court to simulate various situations. The limitation is the player's or coach's imagination. In FIGS. 9A-9C, the apparatus 10 can be set up as two defenders, one with hands up, one with hands down. The player can practice dribbling through and around the two defenders. They can also set up double screens and practice coming off of a double screen. Since the apparatus 10 is manufactured from lightweight yet durable materials, it is easy to move and reposition the apparatus 10 throughout the court.

Figure 10A:
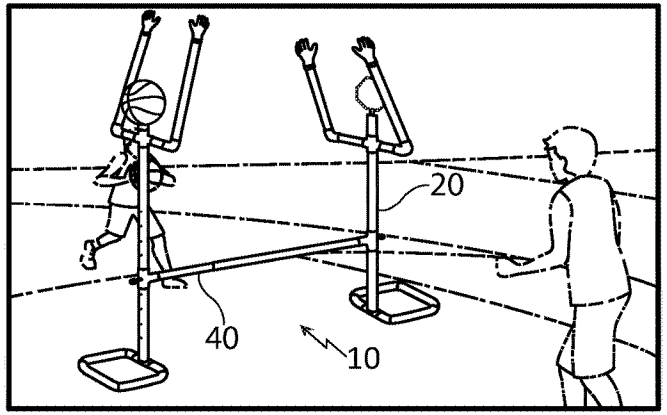
FIGS. 10A-10C are images of the multi-functional basketball cross-training apparatus in use with a basketball athlete in a passing drill position, in accordance with the first exemplary embodiment of the present disclosure.
Figure 10B:
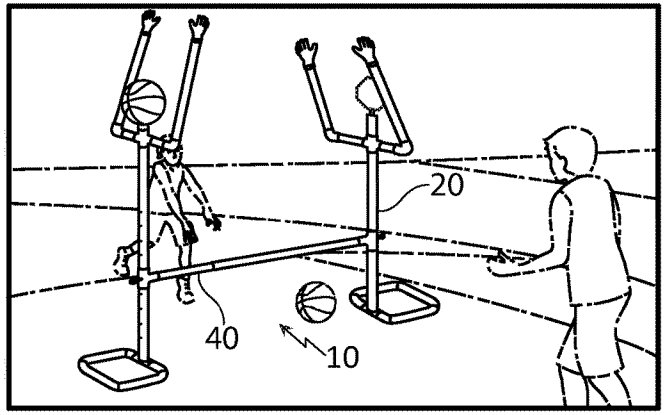
Figure 10C:
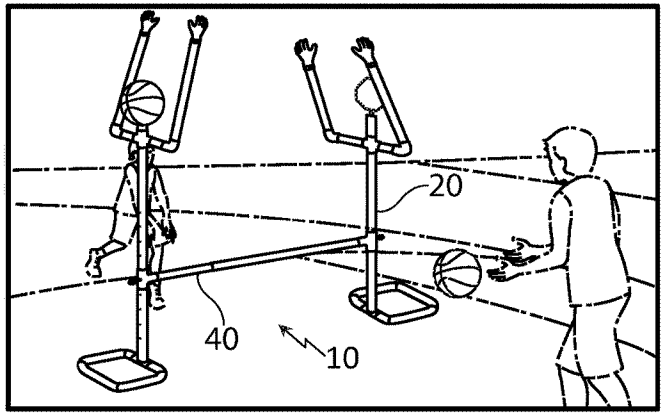

FIGS. 10A-10C are images of the multi-functional basketball cross-training apparatus 10 in use with a basketball athlete in a passing drill position, in accordance with the first exemplary embodiment of the present disclosure. As shown, the apparatus 10 can be used to practice passing skills when two or more players are available. Passing using the apparatus 10 involves the players standing on opposing sides of the cross bar and throwing the ball under the cross bar 40 to practice a bounce pass, or throwing the ball over the cross bar 40 to practice an air pass (not shown). Depending on what angle and how hard the player passes the ball will determine how well they set their teammate up to score. Because the player has to pass under the cross bar 40 when conducting a bounce pass, they get to practice having high accuracy to get the ball to the other side of the cross bar 40. A similar game can be played as the dribbling game, where the goal is to see how many passes the players can make passes under the cross bar 40 (at different angles) without knocking the basketball off of the vertical member 20. By changing the angle, it is possible to have one passer and player going in for a layup. Then they can switch. That way the game works on passes and layups.

FIGS. 11A-11G are images of a multi-functional basketball cross-training apparatus 110 in use with a basketball athlete in various positions, in accordance with a second exemplary embodiment of the present disclosure. The apparatus 110 of FIGS. 11A-11G may be similar to the apparatus 10 of FIGS. 1-10C, in part, and may include any of the features disclosed relative thereto. As shown in FIGS. 11A-11G, the apparatus 110 may include a construction which includes secondary vertical members (in addition to the first vertical members 20 of FIG. 1) which may be positioned substantially parallel to the first vertical members and connected between the bases and the first vertical members with horizontal arms. The secondary vertical members may be shorter than the first vertical members, as shown in FIGS. 11A-11G. The horizontal arms connecting the secondary and first vertical members may connect to the top of the secondary vertical members and a middle area of the first vertical members, depending on the design and implementation. In one example, the secondary vertical members may be located toward the ends of the apparatus 110, such that they do not interfere with the basketball athlete's training. The secondary vertical members may be located in line with the cross bar and the first vertical members on the base. The secondary vertical members may provide additional stability and support to the apparatus 110 during use, and especially if/when an athlete contacts the apparatus 110. Additional ground-interfacing support posts extending horizontally from either side of the two bases may also be used to increase stability of the apparatus 110 and prevent toppling thereof. The secondary vertical members, horizontal arms, and ground-interfacing support posts may be connected to the apparatus 110 by sockets, such as elbow and tee sockets.

Figure 11A:
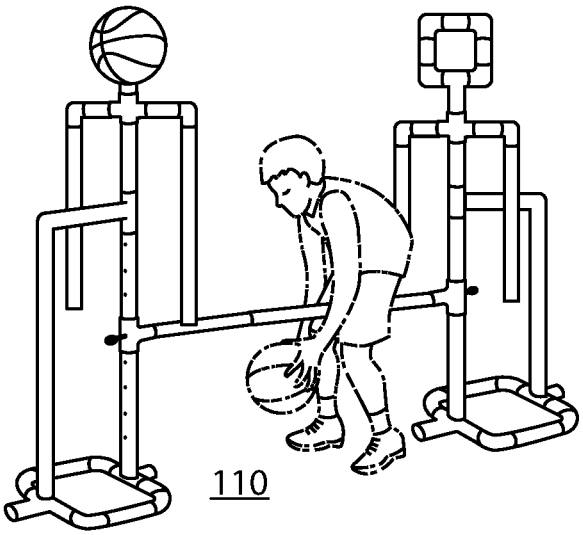
FIGS. 11A-11G are images of a multi-functional basketball cross-training apparatus in use with a basketball athlete in various positions, in accordance with a second exemplary embodiment of the present disclosure.
Figure 11B:
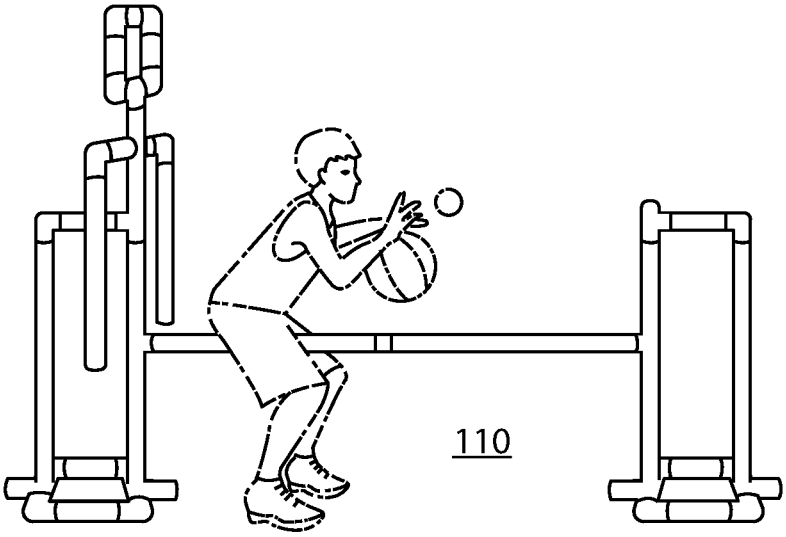

The apparatus 110 may also include a head member which is configured as a square of members or another shape, as shown in FIG. 11A. The head member may be removable as shown in FIG. 11B, along with the arm members, if so desired by the user of the apparatus 110, or the head member may be movable to another location of the apparatus 110.

Figure 11C:
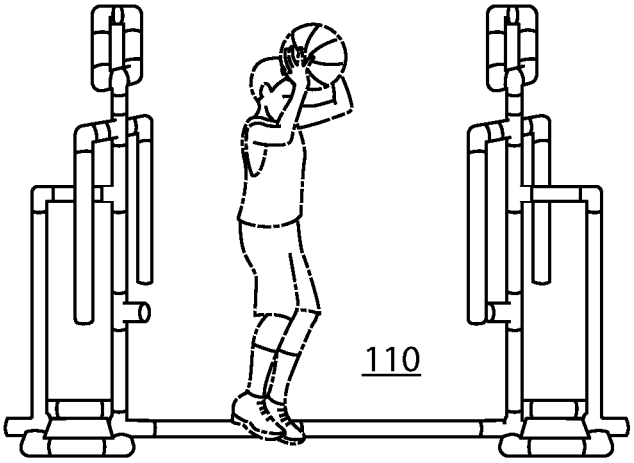
Figure 11D:
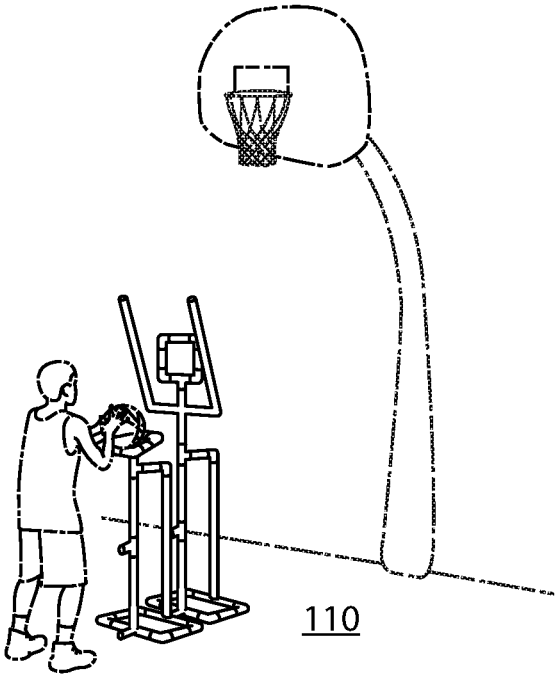
Figure 11E:
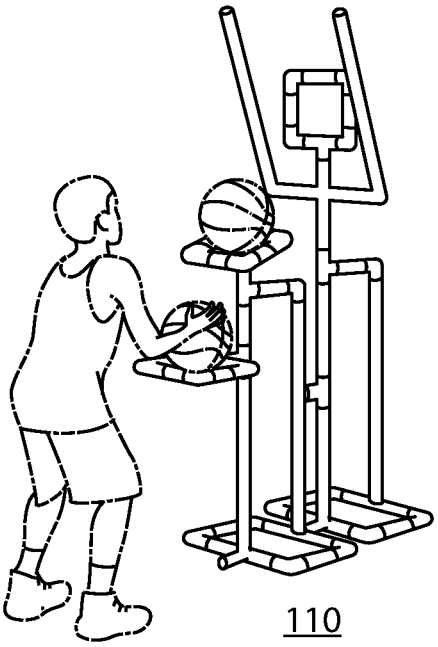
Figure 11F:
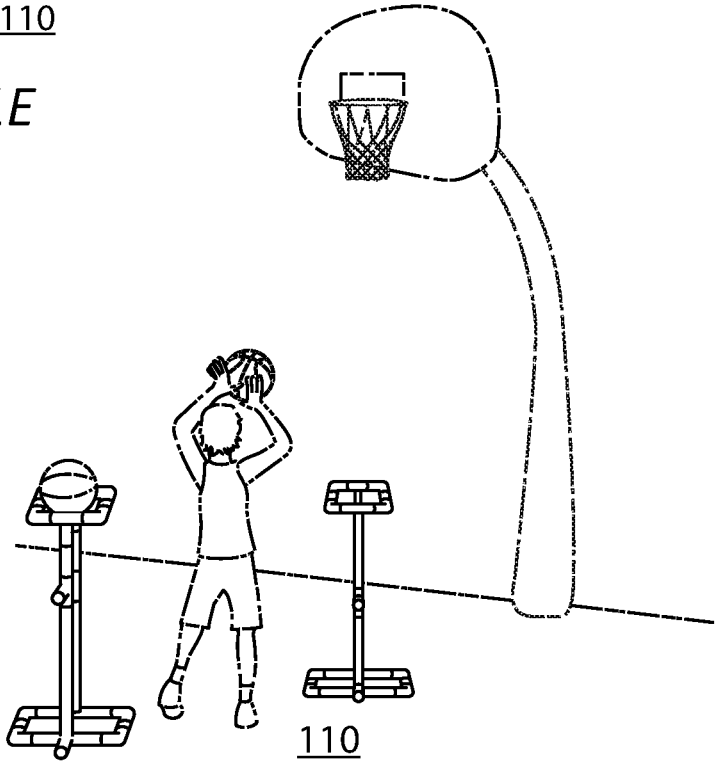
Figure 11G:
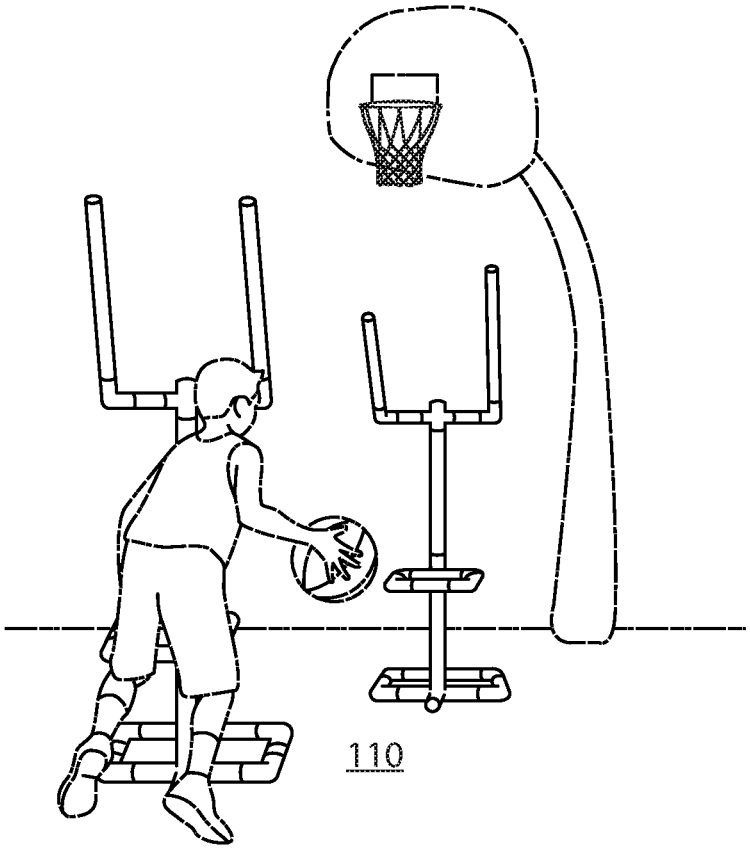

The apparatus 110 may include multiple such head members, as shown in FIG. 11C, or it may include a square head member and a basketball head member, as shown in FIG. 11A. Removal of the head and arm members may make the first vertical member shorter in height. As shown in FIG. 11D, the crossbar member may be removed such that the two bases and vertical members are positioned proximate to one another. In this position, one of the head members may be positioned substantially horizontal on a first vertical member to serve as a basketball holder, whereby the basketball athlete can grab the basketball from the holder during use of the apparatus 110. The other base may be positioned with the arm members raised in the defending position, as shown. In some embodiments, the apparatus 110 may include two basketball holders, as shown in FIG. 11E. The two basketball holders may attach to one of the first vertical members at different heights on the first vertical members. For example, one basketball holder may attach to the first vertical member at the top end of the first vertical member, while the other basketball holder may attach to the first vertical member where the cross bar attaches. In another example, the two holders can be attached to different first vertical members and positioned at different places around a basketball court, as shown in FIG. 11F. The holders can also be lowered closer to the ground surface and the arm members of the apparatus 110 can be placed in a defending position, as illustrated in FIG. 11G. During use, a player may position one of the bases to resemble a defending player, with a head member placed on top of a first vertical member of the base. The player may practice dribbling around, shooting over, or getting past a defender in this way. The second base may be positioned at a second location to resemble another defender, with a head member placed on top of another first vertical member of the second base. Alternatively, the player may desire to position one of the bases to hold a basketball, for example, to practice receiving a pass after running a play. The player may position one of the bases to resemble a defender, and the other base to hold a basketball, for example, to practice moving around a defender to get open for a pass or a shot. A player may desire to place both head members as basketball holders in different locations in order to practice receiving passes after running a play, or taking different shots after running a play. By configuring the head members on the apparatus 110 in these ways, a player is able to use the head members to practice a number of scenarios, including shooting and dribbling near a tall defender, receiving passes, and running plays with opponents nearby. Any other design variations and uses, as depicted in FIGS. 11A-11G, alone or in combination with other figures of this disclosure, can also be used, all such combinations are considered within the scope of the present disclosure.

Figure 12B:
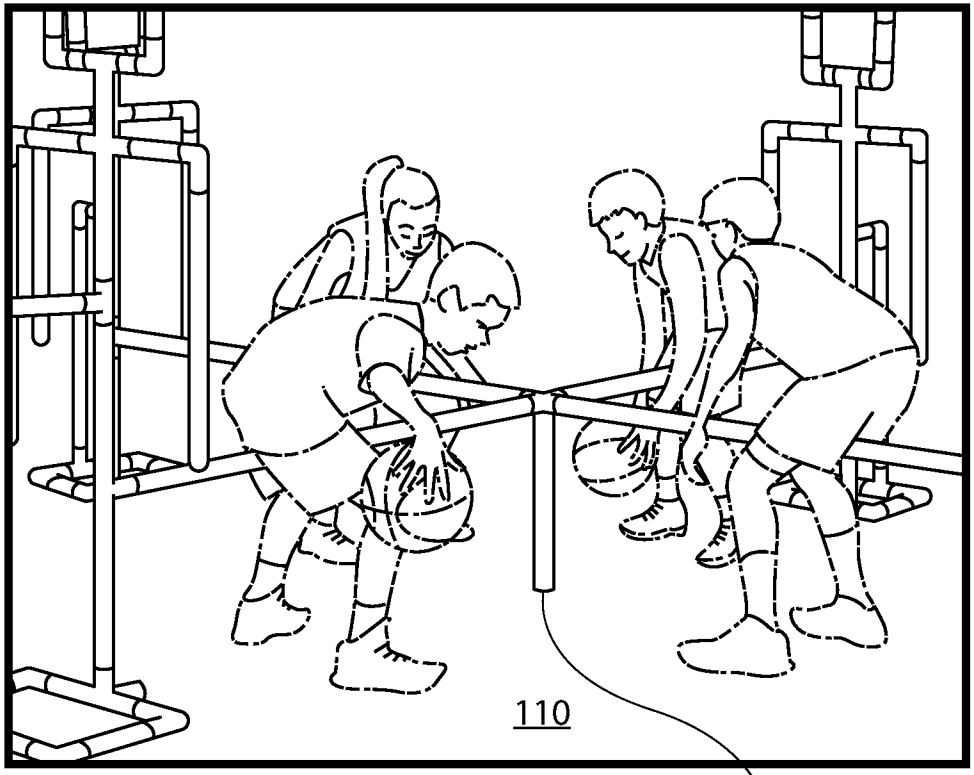
FIG. 12B is an image of the multi-functional basketball cross-training apparatus of FIG. 12A in use, in accordance with the second exemplary embodiment of the present disclosure.
Figure 12A:
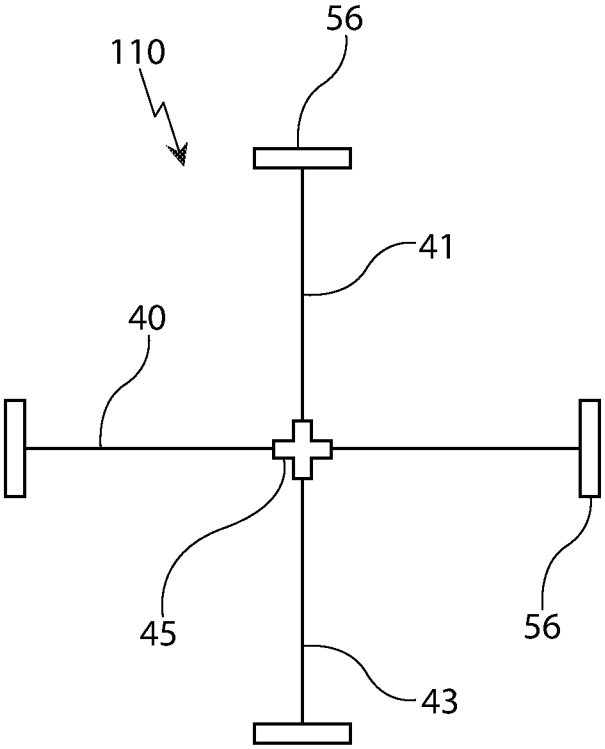
FIG. 12A is a top view of a multi-functional basketball cross-training apparatus with extensions, in accordance with the second exemplary embodiment of the present disclosure.

FIG. 12A is an overhead view of a multi-functional basketball cross-training apparatus 110 with extensions in accordance with a second exemplary embodiment of the present disclosure. A cross piece 45 may be placed in the center of the crossbar 40, allowing one or more extensions to connect to the apparatus 110. The extensions may comprise one or more of the components of the base apparatus, including crossbars 41, 43, head members 56, bases, and vertical members (not pictured). The extensions may be modular; i.e., may be added or removed individually and with or without individual components. For instance, the apparatus 110 may be expanded to accommodate 3 players by adding one extension including the cross piece 45, crossbar 41, head member 56, base, and vertical members. The apparatus 110 may be further expanded to accommodate a $4^{th}$ player by adding an additional crossbar 43, head member 56, base, and vertical members. In one example, the units for certain players, for instance, for the $3^{rd}$ player, may not have a head member 56, while the other units all have head members. In another example, one or more of the crossbars 40, 41, 43 may be located at different heights or angles. The apparatus 110 may be expanded to accommodate any number of players, depending on the space required for the training exercises. One or more cross pieces 45 having a corresponding number of sockets may be used to accommodate a corresponding number of crossbars.

FIG. 12B is an image of the multi-functional basketball cross-training apparatus of FIG. 12A in use. In the example shown in FIG. 12B, the apparatus 110 has been extended to allow 4 players to train simultaneously. Each player is standing over a crossbar attached to a base and vertical members configured to resemble a humanoid defender. An extension post 47 is shown in the center of the crossbars. The extension post 47 may be a vertical member which supports the cross piece 45 connecting each of the crossbars, 40, 41, 43. In one example, the extension post 47 may be any height suitable for practicing a particular skill. For instance, the extension post 47 may be shorter when practicing hops, or higher when practicing shooting form. A single crossbar 40 may extend from one base to another, as shown in FIG. 1, or each player may use an individual crossbar 41,43 extending from their respective bases to the cross piece 45. The apparatus 110 may be configured to allow each player to practice a different exercise, for example, by changing the height of the crossbars, configuring the bases and humanoid defenders, and the like. Players may do an exercise circuit, moving from one part of the apparatus to another, then to another, and so on. In addition to being more efficient in use of time, this extension further allows young players to practice dribbling, passing, footwork, and jumping with a number of other players around, building confidence under pressure.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claim.

What is claimed is:

1. A multi-functional basketball cross-training apparatus comprising:

at least two vertical members;

at least two bases connected to a lower portion of the at least two vertical members, respectively, wherein the at least two bases provide support for the at least two vertical members on a ground surface;

at least one cross bar removably connectable between the at least two vertical members, wherein the at least one cross bar is position-adjustable along a vertical height of each of the two vertical members; and an upper portion of the at least two vertical members, each upper portion having a plurality of members having a humanoid configuration and a head member located proximate to a top end of each of the at least two vertical members, wherein the head member comprises interconnected members formed in a shape with a plurality of sides, wherein an open interior portion is formed between the plurality of sides, and wherein the open interior portion of the interconnected members forming the plurality of sides is sized smaller than a diameter of a basketball in order to prevent the basketball from falling through the open interior portion, wherein the head member is pivotal removably positionable between a stationary horizontal orientation and a stationary vertical orientation, wherein in the stationary horizontal orientation the head member is configured to act as a holder of the basketball, whereby the basketball is positionable on the head member with at least a portion of the basketball extending into the open interior portion, and wherein in the stationary vertical orientation, the head member resembles a head of a defender.

2. The apparatus of claim 1, wherein at least a portion of the plurality of members comprises arms and is rotatable between a raised and a lowered position.

3. The apparatus of claim 2, further comprising a horizontal shoulder member connected to the arms at a proximal end of the arms and attached to the upper portion of one of the at least two vertical members, wherein the arms are rotatable about the horizontal shoulder member.

4. The apparatus of claim 1, further comprising at least two secondary vertical members positioned parallel to the at least two vertical members on the at least two bases, respectively, the at least two secondary vertical members connected to the at least two vertical members by at least two horizontal arms.

5. The apparatus of claim 1, wherein the shape with the plurality of sides further comprises a square shape formed from at least four interconnected members.

6. The apparatus of claim 1, wherein when the head member is in the stationary horizontal orientation, the interconnected members forming the shape with the plurality of sides are positioned perpendicular to each of the at least two vertical members, respectively.

7. The apparatus of claim 1, wherein the head member is connected to the top end of each of the at least two vertical members, respectively.

8. A multi-functional basketball cross-training apparatus comprising:

at least one vertical member;

at least one base connected to a lower portion of the at least one vertical member, wherein the at least one base supports the at least one vertical member on a ground surface;

at least one cross bar removably connectable to the at least one vertical member, wherein the at least one cross bar is position-adjustable along a vertical height of the at least one vertical member; and an upper portion of the at least one vertical member, the upper portion having a plurality of members having a humanoid configuration and a head member located proximate to a top end of at least one of the vertical members, wherein the head member comprises interconnected members formed in a shape with four sides, wherein an open interior portion is formed between the four sides, and wherein the open interior portion of the interconnected members forming the four sides is sized smaller than a diameter of a basketball in order to prevent the basketball from falling through the open interior portion, wherein the head member is removably positionable between a stationary horizontal orientation and a stationary vertical orientation, wherein in the stationary horizontal orientation the head member is configured to act as a holder of the basketball, whereby the basketball is positionable on the head member with at least a portion of the basketball extending into the open interior portion and wherein in the stationary vertical orientation, the head member resembles a head of a defender.

9. The apparatus of claim 8, wherein the shape with at least four sides further comprises a square shape formed from at least four interconnected members.

10. The apparatus of claim 8, wherein when the head member is in the horizontal orientation, the interconnected members forming the shape with at least four sides are positioned perpendicular to the at least one vertical member.

11. The apparatus of claim 8, wherein the head member is connected to the top end of the at least one vertical member.

* * * * *